US007051528B2

(12) United States Patent
Daunas

(10) Patent No.: US 7,051,528 B2
(45) **Date of Patent: *May 30, 2006**

(54) AUTONOMOUS GAS POWERED RAM

(75) Inventor: Yves Daunas, Les Bruyères le Briou (La Tuilerie), 45240 Menestreau en Villette (FR)

(73) Assignee: Yves Daunas, Menestreau en Villette (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/682,488

(22) Filed: Oct. 10, 2003

(65) Prior Publication Data

US 2004/0128998 A1 Jul. 8, 2004

Related U.S. Application Data

(63) Continuation-in-part of application No. 09/978,675, filed on Oct. 18, 2001, now Pat. No. 6,655,143.

(30) Foreign Application Priority Data

Aug. 17, 2001 (CA) ..... 2355504

(51) Int. Cl.
*F01B 29/08* (2006.01)

(52) U.S. Cl. ..... 60/638; 60/632; 60/635

(58) Field of Classification Search ..... 60/632, 60/635, 638

See application file for complete search history.

(56) References Cited

U.S. PATENT DOCUMENTS

| | | | | |
|---|---|---|---|---|
| 2,639,913 | A | | 5/1953 | Reynolds |
| 3,010,752 | A | | 11/1961 | Geffner |
| 3,118,349 | A | | 1/1964 | Combs |
| 3,199,288 | A | | 8/1965 | Nahas |
| 3,762,514 | A | | 10/1973 | Freitag |
| 3,888,085 | A | | 6/1975 | Larsonneur |
| 3,915,242 | A | | 10/1975 | Bell |
| 4,091,621 | A | | 5/1978 | Patrichi |
| 4,237,690 | A | | 12/1980 | Tsuge et al. |
| 4,412,420 | A | | 11/1983 | Patrichi et al. |
| 4,860,698 | A | | 8/1989 | Patrichi et al. |
| 4,945,730 | A | | 8/1990 | Laney |
| 5,454,622 | A | | 10/1995 | Demopoulos |
| 5,538,172 | A | * | 7/1996 | Jochum et al. ..... 227/10 |
| 5,791,597 | A | | 8/1998 | Knoll |
| 5,950,900 | A | * | 9/1999 | Frommelt et al. ..... 227/9 |
| 6,085,958 | A | * | 7/2000 | Kersten ..... 227/10 |
| 6,109,689 | A | | 8/2000 | Nanni |
| 6,113,185 | A | | 9/2000 | Yamaguchi et al. |
| 6,655,143 | B1 | * | 12/2003 | Daunas ..... 60/635 |

FOREIGN PATENT DOCUMENTS

| | | |
|---|---|---|
| DE | 37 27 666 A1 | 3/1989 |
| JP | 55-152903 | 11/1980 |

* cited by examiner

*Primary Examiner*—Hoang Nguyen

(57) ABSTRACT

The present invention provides an autonomous ram that comprises a first body having a first internal cavity and a first piston mounted therein. The first piston is attached to an actuator for moving the actuator between a first operative position and a second operative position. The ram further comprises a second body mounted within the first internal cavity. The second body comprises a second internal cavity that is defined by an internal wall having a locking portion. An explosive charge is located in the second internal cavity and is adapted for detonating in response to an impulse. A second piston located within the second internal cavity is operative for causing a rod to move from a first position to a second position in response to the detonation of the explosive charge. The displacement of the rod causes the actuator to move towards the second operative position. In the second position the rod is engaged with the locking portion of the second body.

25 Claims, 11 Drawing Sheets

AUTONOMOUS GAS POWERED RAM

CROSS REFERENCE TO RELATED APPLICATIONS

The present application is a continuation-in-part of patent application Ser. No. 09/978,675 filed on Oct. 18, 2001 now U.S. Pat. No. 6,655,143 claiming priority upon Canadian application serial No. 2,355,504 filed on Aug. 17, 2001. The contents of the above documents are incorporated herein by reference.

FIELD OF THE INVENTION

The present invention relates to an autonomous gas powered ram comprising an actuator that is movable from a first operative mode to a second operative mode, movement of the actuator towards the second operative mode is caused by the detonation of an explosive charge located within the ram.

BACKGROUND OF THE INVENTION

In many mechanical systems, it is often necessary to provide an actuator that can be used to activate a certain component or functions when an emergency arises. One specific example is to bring an elevator car to a stop. Current available technologies accomplish this task by using electrically, hydraulically or pneumatically powered sources. This approach is unsatisfactory because of the inherent complexity of the systems using these types of powered sources which reduces their reliability. Accordingly, there is a need in the industry to provide a novel device that can be used to provide or perform an emergency function and which is simple and more reliable than prior art systems.

SUMMARY OF THE INVENTION

As embodied and broadly described herein, the invention provides an autonomous gas powered ram. The ram comprises a first body that defines a first internal cavity and a first piston mounted within the first internal cavity. The first piston is attached to an actuator and is operative for moving the actuator between a first operative position and a second operative position in relation to the first body. The second operative position is different than the first operative position. The ram further comprises a second body that is mounted within the first internal cavity. The second body comprises a second internal cavity, an explosive charge and a second piston. The second internal cavity is defined by an internal wall that comprises a locking portion. The explosive charge is also located in the second internal cavity and is adapted for detonating in response to an impulse. The second piston is located within the second internal cavity and is attached to a rod. The second piston is operative for causing the rod to move from a first position to a second position in response to the detonation of the explosive charge. The displacement of the rod from the first position to the second position causes the actuator to move towards the second operative position, and in the second position the rod is engaged with the locking portion of the second body in order to prevent the actuator from returning to the first operative position.

As embodied and broadly described herein, the invention further provides a cartridge suitable for being mounted within the main body of a ram having a cavity with a piston mounted therein for moving an actuator between a first operational position and a second operational position. The cartridge comprises an internal cavity, an explosive charge, and a piston. The internal cavity is defined by an internal wall that comprises a locking portion. The explosive charge is located in the internal cavity and is adapted for detonating in response to an impulse. The piston is also located within the internal cavity and is attached to a rod for causing the rod to move from a first position to a second position in response to the detonation of the explosive charge. Displacement of the rod from the first position to the second position causes the actuator to move towards the second operative position. In the second position the rod is engaged with the locking portion in order to prevent the actuator from returning to the first operative position.

As embodied and broadly described herein, the invention further provides a ram. The ram comprises a main body, a first piston, a second piston, an actuator, a fluid-pathway and an explosive charge. The main body comprises an internal cavity in which is slidingly mounted the first piston. The second piston is at least partially mounted in the first piston. The actuator is mounted in the main body, and is coupled to the first piston being in a driving relationship. As such, movement of the first piston in the internal cavity causes displacement of the actuator with relation to the main body. The fluid-pathway opening is in the internal cavity for admitting pressurized working fluid to act on the first piston to move the first piston and displace the actuator. The explosive charge is located within the ram. The explosive charge is adapted to detonate in response to the application of an impulse thereto. The detonation of the explosive charge causes movement of the second piston thereby displacing the actuator relative to the main body. The displacement of the actuator is independent of the pressurized working fluid.

As embodied and broadly described herein, the invention further provides an autonomous gas powered ram. The ram comprises a main body, a first piston, a second piston, an actuator and an explosive charge. The main body comprises an internal cavity and the first piston is capable of movement in the internal cavity. The second piston is at least partially mounted in the first piston. An actuator is mounted in the internal cavity. The actuator is movable in the internal cavity from a first operative mode to a second operative mode. In the first operative mode, the actuator is in a first position relative to the main body. In the second operative mode the actuator is in a second position relative to the main body. The first position is different from the second position. The actuator is connected to the first piston such that movement of the first piston in the internal cavity causes displacement of the actuator between the operative modes. The explosive charge is in a detonation chamber that is located within the ram. The explosive charge is adapted for detonating in response to an impulse thereto. The detonation of the explosive charge causes movement of the second piston thereby displacing the actuator towards the second operative mode. The internal cavity comprises a gas expansion chamber communicating with the detonation chamber once the actuator moves towards the second operative mode. The volume of the gas expansion chamber is at least equal to the volume of the detonation chamber.

BRIEF DESCRIPTION OF THE DRAWINGS

A detailed description of the embodiments of the invention is provided herein below with reference to the following drawings, wherein.

Figure 1:
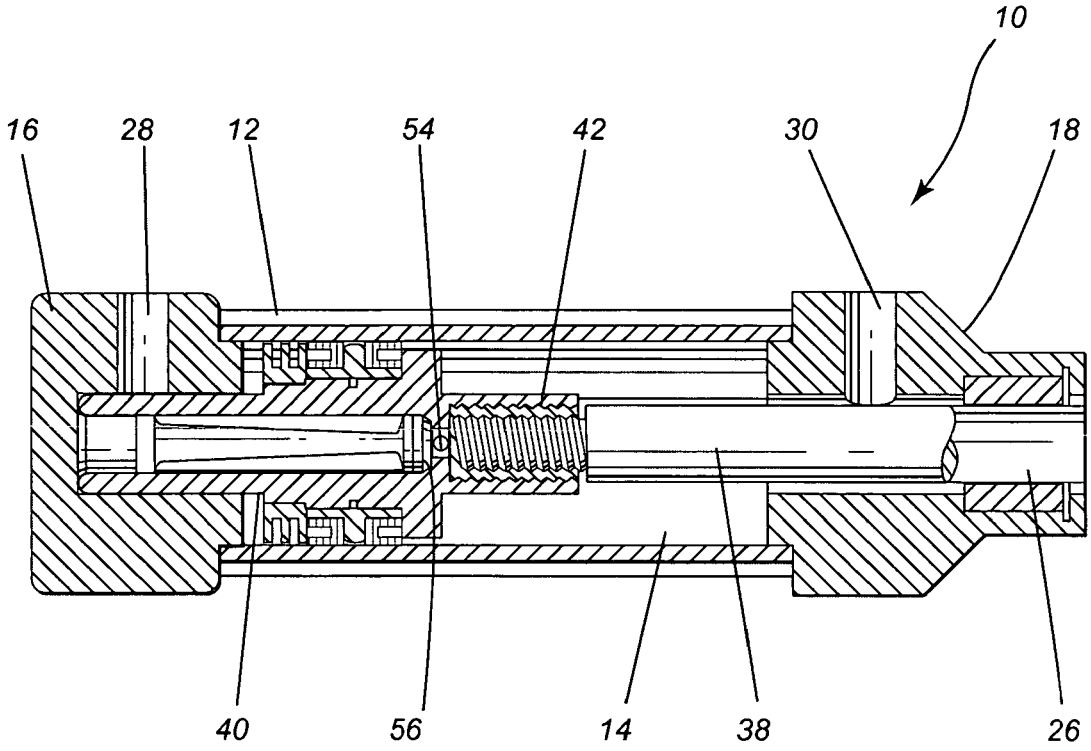
FIG. 1 is a cross sectional view of an autonomous gas powered ram comprising an actuator connected to a piston constructed in accordance with a first embodiment of the invention.

In the drawings, embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS

Figure 2:
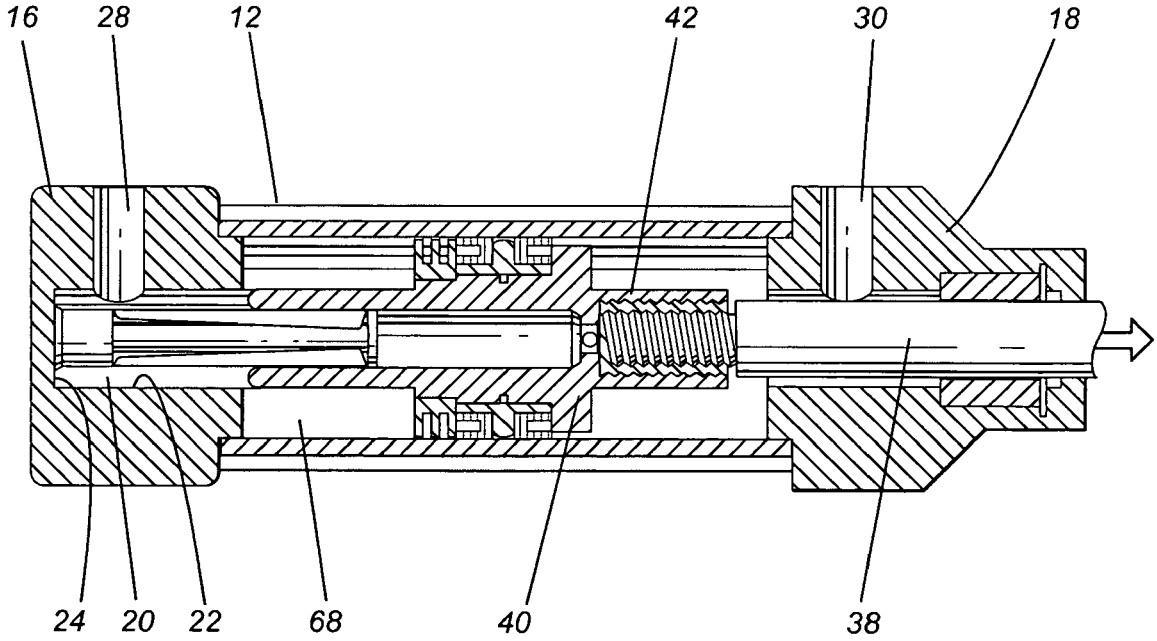
FIG. 2 is a cross sectional view of the autonomous gas powered ram of FIG. 1 wherein the actuator is illustrated during the movement towards a second operative mode.
Figure 3:
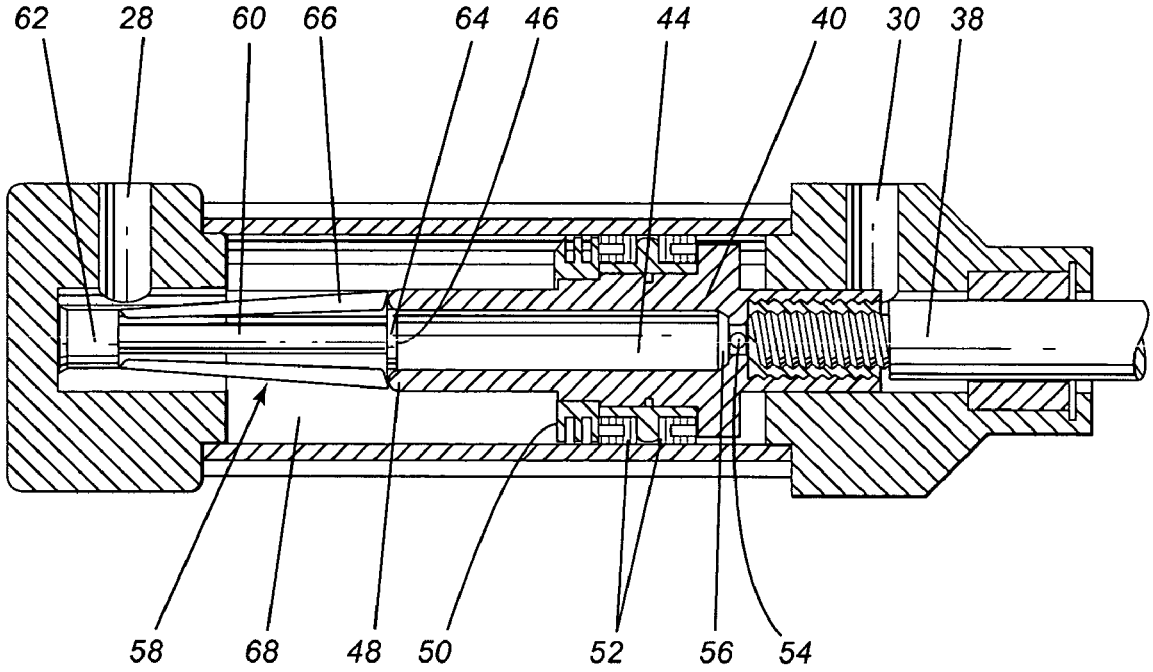
FIG. 3 is a cross sectional view of the autonomous gas powered ram of FIG. 1 wherein the actuator is illustrated in the second operative mode.

With reference to FIGS. 1 to 3, an autonomous gas powered ram constructed in accordance with the first embodiment of the invention is identified by the reference numeral 10.

Autonomous gas powered ram 10 can be incorporated to any component such as an elevator, a crane, a lift, a door, a gate, wheels, gears or breaking devices for stopping the movement of a component upon detection of an operation failure, a fire or a hazardous operation condition.

For example, autonomous gas powered ram 10 can stop the movement of an elevator, a gate or a lift upon detection of a rupture of a cable. It can also keep the doors of a building in their open position upon detection of a fire so as to permit the evacuation of people situated in the building through the open doors. It can stop the movement of a seat upon detection of a vehicle collision. It can stop the movement of a vehicle upon detection of a failure of its breaking system, or it can keep the doors of a building or an armored truck in the closed position upon detection of the presence of a thief therein.

Autonomous gas powered ram 10 comprises a main body 12 having an internal cavity 14. Main body 12 can be made of a variety of different materials and can be of a variety of different shapes. Autonomous gas powered ram 10 also comprises first and second end portions 16 and 18 closing said main body 12 at its ends. First end portion 16 comprises a chamber 20 having peripheral wall 22 and an abutting wall 24. Second end portion 18 comprises a passageway 26 communicating with the exterior of main body 12. Ram 10 may also comprise fluid-pathway openings 28 and 30 for admitting pressurized working fluid within main body 12.

Ram 10 further comprises an actuator 38 connected to a piston 40. Actuator 38 is connected to piston 40 with a ring 42 that electrically isolates actuator 38 from piston 40. Piston 40 is therefore incapable of conducting any electricity that may be present in actuator 38.

Piston 40 comprises an internal wall surrounding a detonation chamber 44 having an orifice 46 at an end portion 48. Piston 40 also comprises an electrically conducting member 50 and sealing rings 52 mounted around piston 40. Member 50 is made of an electrically conductive material capable of conducting a weak current (+/−25 mV for example). Sealing rings 52 are made of a synthetic material for maintaining a sealing engagement with the peripheral wall of internal cavity 14.

Autonomous gas powered ram 10 also comprises a detonator 54 and an explosive charge 56 connected to detonator 54. The explosive charge 56 is located within detonation chamber 44. Detonator 54 is chemically sensitive and/or electro-sensitive in order to trigger explosive charge 56 upon detection of a chemical reaction or an electric current. Ram 10 also comprises an electric impulse pathway leading from explosive charge 56 to the exterior of main body 12. It is also understood that detonator 54 may trigger explosive charge 56 upon detection of a physical changes such as a pressure variation. Different suitable detonators are well known for the person skilled in the art and no further description is required concerning the various possibilities for triggering explosive charge 56.

Upon detonation of explosive charge 56, movement of piston 40 causes displacement of actuator 38 from a first operative mode to a second operative mode. In the first operative mode, actuator 38 is in a first position relative to main body 12 while, in the second operative mode, actuator 38 is in a second position relative to main body 12. The first position of actuator 38 is different from the second position.

Autonomous gas powered ram 10 further comprises a second piston 58 having a stem 60 with an abutting member 62 at one end and a disc 64 at the other end. Second piston 58 is slidingly mounted within detonation chamber 44. In fact, the diameter of disc 64 is slightly smaller than that of detonation chamber 44 in order to allow displacement of second piston 58 relative to detonation chamber 44. Second piston 58 also comprises latch members in the form of fins 66 attached at one of their ends to abutting member 62.

Second piston 58 with latch members constitutes a lock that prevents actuator 38 from moving to the first operative mode when explosive charge 56 has detonated.

In FIG. 1, autonomous gas powered ram 10 is illustrated with actuator 38 being in the first operative mode wherein it is entirely confined within main body 12. In operation, when an operation failure, a fire or a hazardous operation condition is detected wherein it is required that actuator 38 is actuated by an autonomous source, explosive charge 56 detonates and generates a quantity of gas injected into detonation chamber 44. To this effect, detonator 54 may be connected to a sensor, and when an operation failure is detected, an electric current is supplied to detonator 54. A chemical or physical reaction producing the same effect is also within the scope of the invention. The gas then expands within detonation chamber 44 and pistons 40 and 58 move relative to each other in response to generation of the gas. Movement of piston 40 causes displacement of actuator 38 towards the second operative mode, as shown in FIG. 2.

It is understood that as soon as explosive charge 56 is triggered and the gas is generated into detonation chamber 44, abutting member 62 abuts against abutting wall 24 and the gas pressure is applied afterwards on disc 64 thereby moving piston 40 relative to second piston 58.

Detonation chamber 44 has a diameter that slightly increases towards orifice 46 to define a gap between disc 64 and the peripheral wall of detonation chamber 44 that progressively widens as second piston 58 projects from detonation chamber 44, this gap allows the gas generated by the detonation of explosive charge 56 to escape from detonation chamber 44. In that sense, once explosive charge 56 has detonated, detonation chamber 44 communicates with an expansion chamber 68 in order to allow gradual dissipation of pressure and heat. This leakage of gas is intended to avoid an increase in temperature and/or pressure within detonation chamber 44 that could damage the various components of the autonomous gas powered ram of the invention. The volume of expansion chamber 68 may be five to fifteen times larger than the volume of detonation chamber 44, in order to dissipate the heat and pressure generated in this detonation chamber.

As actuator 38 moves towards the second operative mode, fins 66 are withdrawn from detonation chamber 44, and once they are entirely located outside this chamber, fins 66 then deploy and project transversally due to their resiliency. Once fins 66 have been entirely deployed, they no longer fit within detonation chamber 44 and instead engage end portion 48 of piston 40 thereby preventing actuator 38 from moving back to the first operative mode. Fins 66 mounted on second piston 58 thus constitute a lock that prevents actuator 38 from moving to first operative mode once it has moved into the second operative mode.

Should the gas injected into detonation chamber 44 eventually escape, the fins 66 still prevent actuator 38 from moving back towards the first operative mode. As seen in FIG. 3, actuator 38 projects from main body 12 in the second operative mode.

If ram 10 includes fluid-pathway openings 28 and 30 for admitting pressurized working fluid acting on piston 40, piston 40 is coupled to actuator 38 in a driving relationship whereby movement of piston 40 causes displacement of actuator 38 with relation to main body 12. Moreover, the displacement of actuator 38 resulting from detonation of explosive charge 56 is independent from the displacement of actuator 38 resulting from movement of piston 40 due to the pressurized working fluid.

Second and third embodiments are illustrated in FIGS. 4 to 7. Since these embodiments are similar to the first embodiment, the components used in common to the embodiments are identified by the same reference numerals, and a description of such components will be omitted herein.

Figure 4:
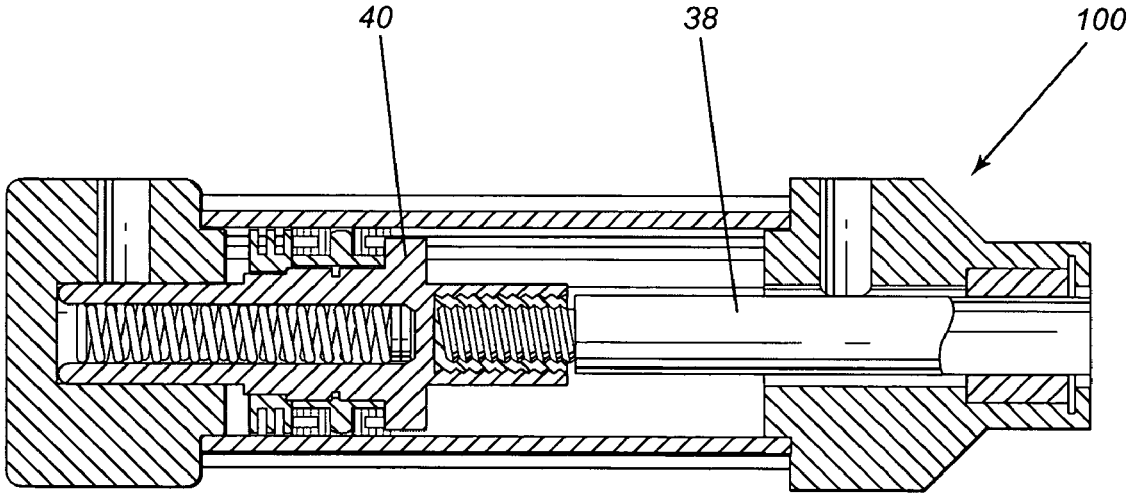
FIG. 4 is a cross sectional view of an autonomous gas powered ram constructed in accordance with a second embodiment of the invention.
Figure 5:
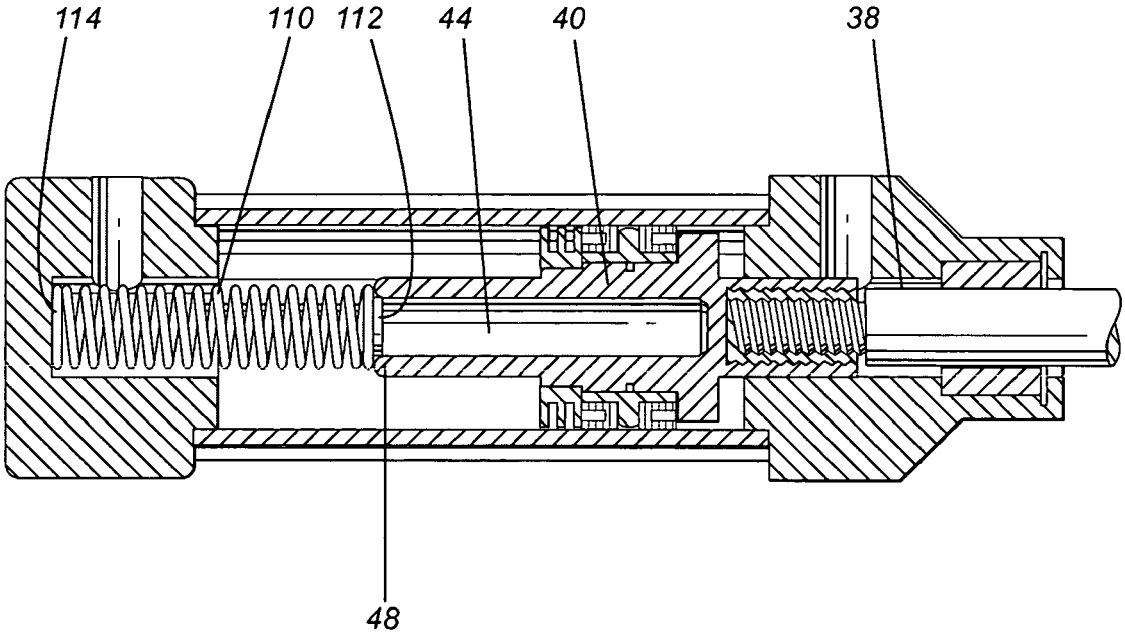
FIG. 5 is a cross sectional view of the autonomous gas powered ram of FIG. 4 wherein the actuator is illustrated in the second operative mode.

In FIGS. 4 and 5, autonomous gas powered ram 100 comprises a spring 110 having a disc 112 at one end and an abutting portion 114 at the other end. In FIG. 4, autonomous gas powered ram 100 is illustrated with actuator 38 being in the first operative mode wherein it is entirely confined within main body 12.

In operation, when an operation failure is detected, actuator 38 is displaced due to the gas pressure created within detonation chamber 44. As actuator 38 moves towards the second operative mode, spring 110 is withdrawn from detonation chamber 44, and once it is entirely located outside this chamber, spring 110 no longer fit within detonation chamber 44 since it is not compressed anymore. Spring 110 thus engages end portion 48 of piston 40 thereby preventing actuator 38 from moving to first operative mode (see FIG. 5). Spring 110 thus constitutes a lock moveable along a first path of travel while actuator 38 connected to first piston 40 is moveable along a second path of travel, the first and the second paths of travel being parallel.

Figure 6:
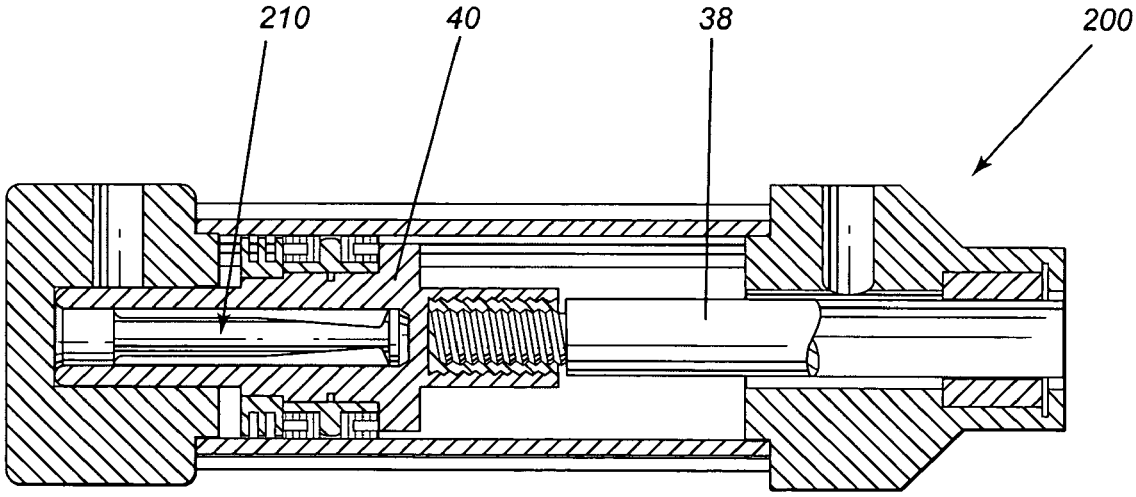
FIG. 6 is a cross sectional view of an autonomous gas powered ram constructed in accordance with a third embodiment of the invention.
Figure 7:
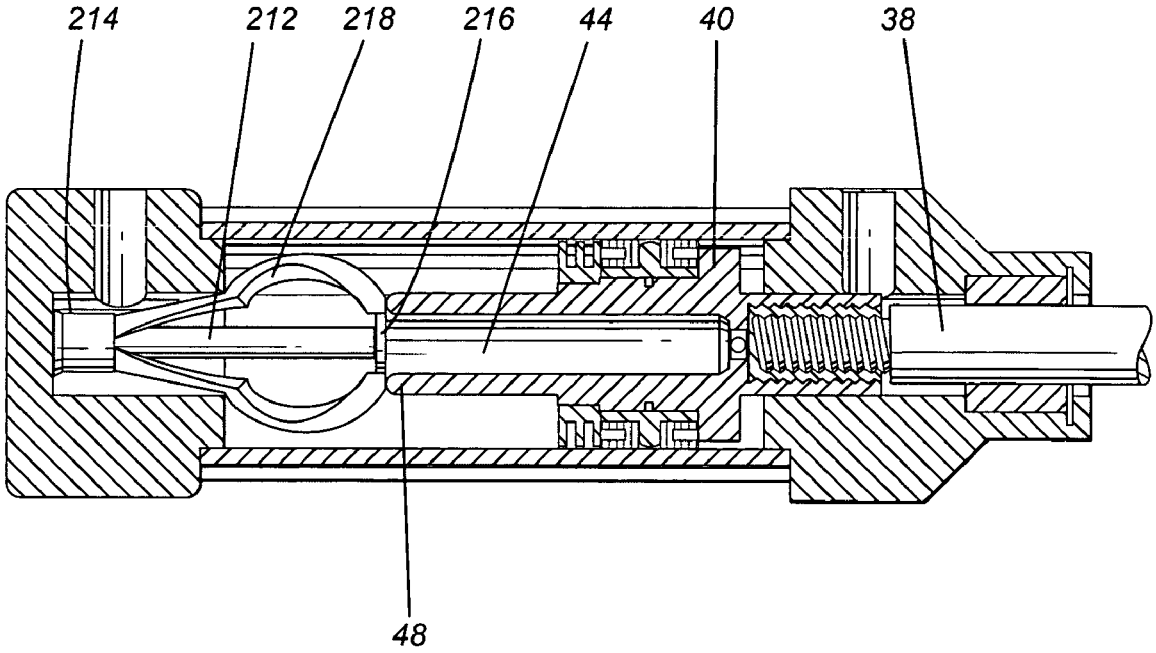
FIG. 7 is a cross sectional view of the autonomous gas powered ram of FIG. 6 wherein the actuator is illustrated in the second operative mode.

In FIGS. 6 and 7, autonomous gas powered ram 200 comprises a second piston 210. In FIG. 6, autonomous gas powered ram 200 is illustrated with actuator 38 being in first operative mode.

Second piston 210 comprises a stem 212 having an abutting portion 214 at one end and a disc 216 at the other end. Second piston 210 further comprises bendable fins 218 affixed at one end to abutting portion 214 and to disc 216 at the other end.

In operation, when an operation failure is detected, actuator 38 is displaced due to the gas pressure created within detonation chamber 44. As actuator 38 moves towards the second operative mode, bendable fins 218 are withdrawn from detonation chamber 44, and once they are entirely located outside this chamber, they do no longer fit within detonation chamber 44 since they are deformed upon movement of actuator 38 towards the first operative mode. Bendable fins 218 thus engage end portion 48 of piston 40 thereby preventing actuator 38 from further moving towards the first operative mode (see FIG. 7). It is understood that the size and material of bendable fins 218 is selected in order to allow the specific amount of deformation necessary to prevent actuator 38 from moving to the first operative mode. Bendable fins 218 mounted on second piston 210 thus constitute a lock that prevents actuator 38 from moving to first operative mode once it has moved into the second operative mode. This lock is moveable along a first path of travel and actuator 38 connected to first piston 40 is moveable along a second path of travel, the first and the second paths of travel being parallel.

Figure 8:
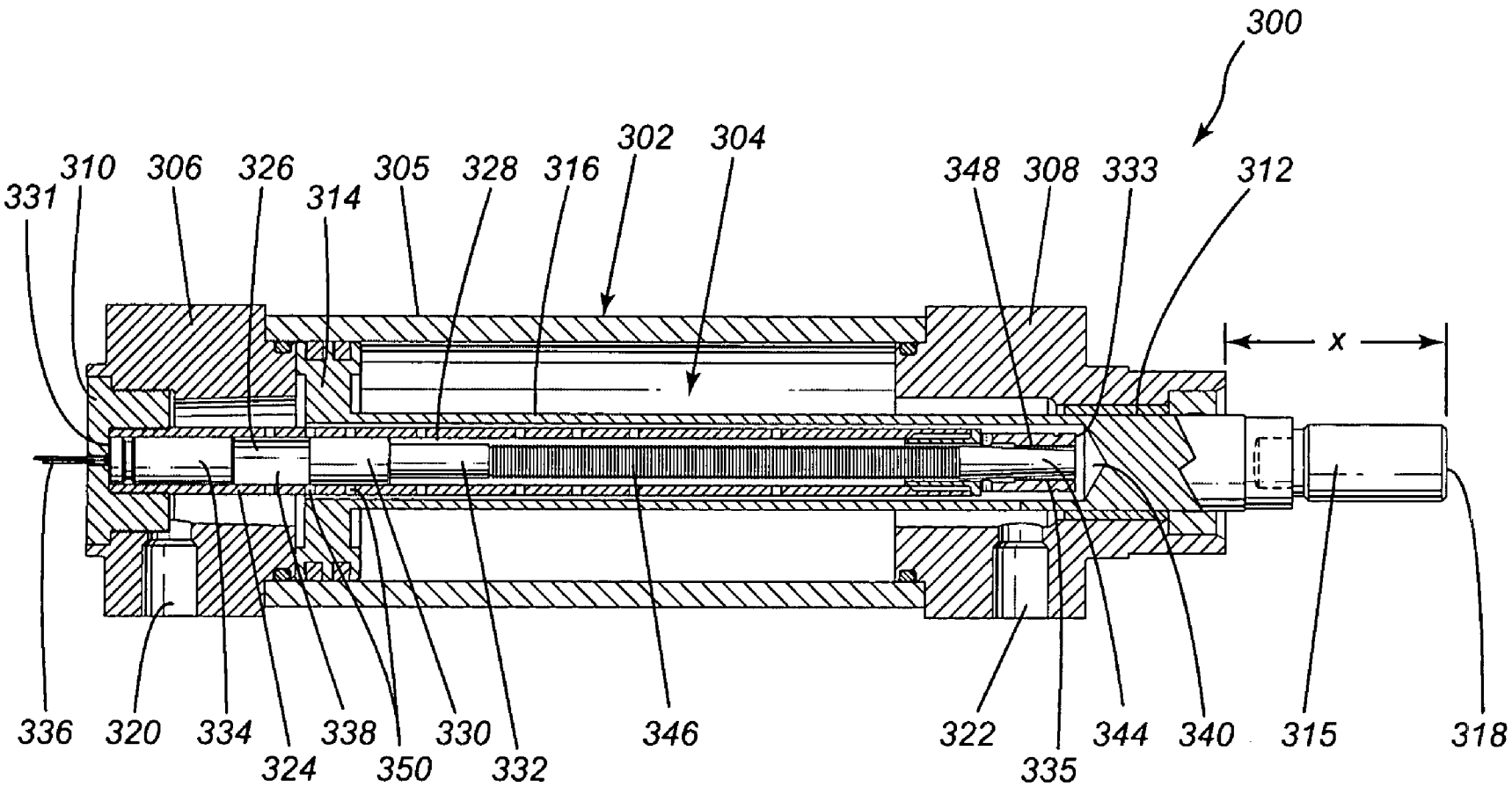
FIG. 8 is a cross sectional view of an autonomous ram comprising a piston and an actuator constructed in accordance with a fourth embodiment of the invention.
Figure 9:
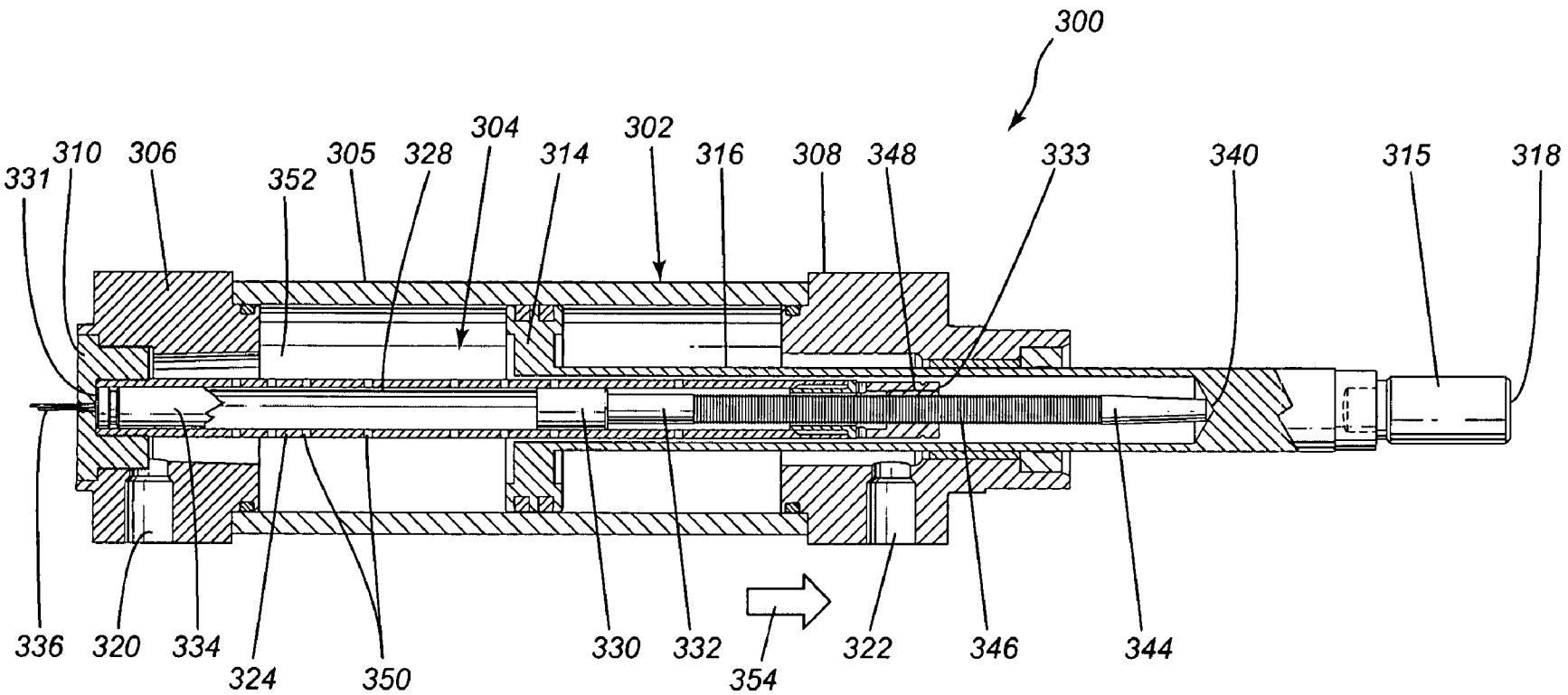
FIG. 9 is a cross sectional view of the autonomous ram of FIG. 8 wherein the actuator is illustrated during its movement towards a second operative position.
Figure 10:
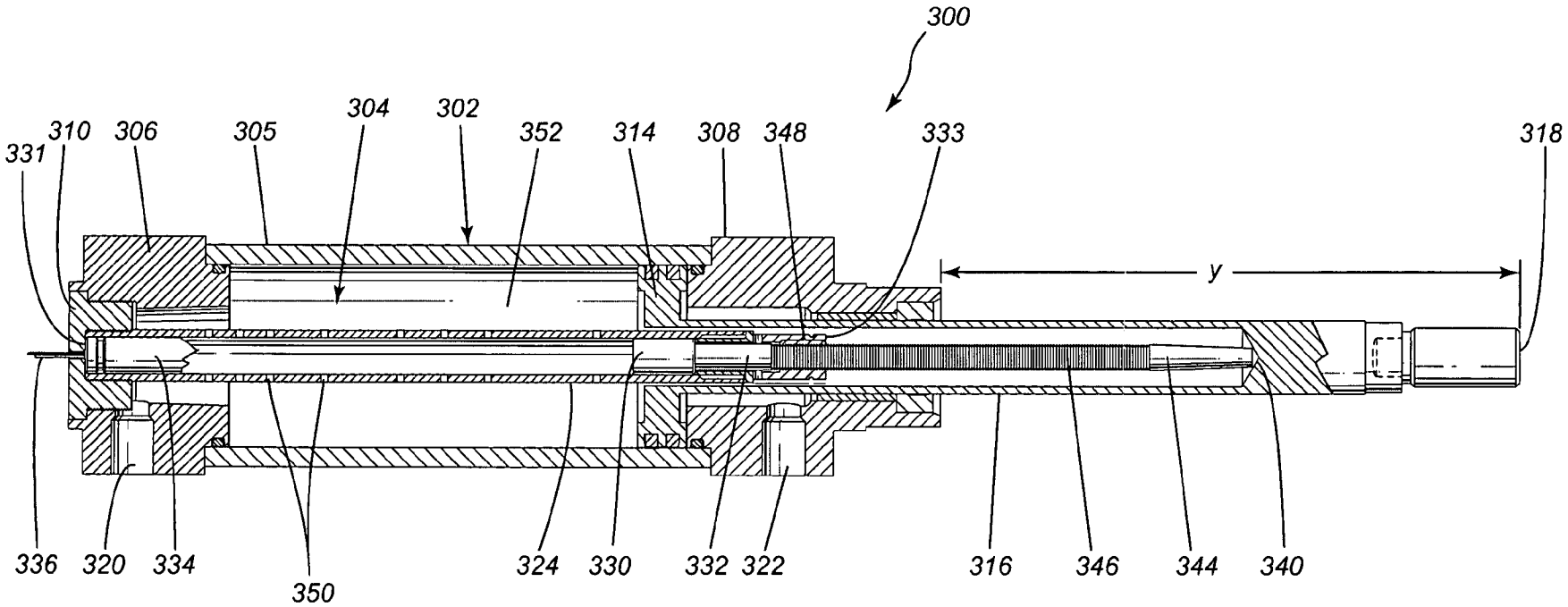
FIG. 10 is a cross sectional view of the autonomous ram of FIG. 8 wherein the actuator is illustrated in the second operative position.

Shown in FIGS. 8 to 10 is an autonomous ram 300 in accordance with a fourth embodiment of the present invention.

Autonomous ram 300 comprises a first body 302 having a first internal cavity 304. The first body 302 comprises a central portion 305, a first end portion 306 and a second end portion 308, which as shown in FIGS. 8 to 10 can be separate parts that are connected together to form the first body 302. In an alternative embodiment, the central portion 305, first end portion 306 and second end portion 308 can be formed as one integral component. It will be appreciated that the first body 302 can be made of a variety of different materials, and can be made in a variety of different shapes, without departing from the spirit of the invention.

As shown in FIGS. 8 to 10, the first end portion 306 of the first body 302 includes a cap 310 that is removably connected to the first body 302 via threads. The second end portion 308 defines a passageway 312 that communicates with the exterior of the first body 302.

Ram 300 further comprises a first piston 314 that is slidably mounted within the first internal cavity 304. The first piston 314 is attached to an actuator 316 that has a distal end 318 that extends through passageway 312. As used for the purposes of the present invention, the term "attached" can refer to two parts that are formed separately and then joined together, or two parts that are integrally formed as one piece. In the embodiment shown in FIGS. 8 to 10, the actuator 316 itself is formed of the combination of two pieces, namely a drive rod that is attached to the piston 314 and an external component 315 that forms the distal end 318 of the actuator 316.

The first piston 314 is operative for moving the actuator 316 between a first operative position and a second operative position in relation to the first body 302. As such, the first body 302 includes fluid pathways 320 and 322 for admitting pressurized working fluid into the first internal cavity 304 for acting on the first piston 314. The pressurized working fluid enables the first piston 314 to move the actuator 316 between the first operative position and the second operative position. The ram 300 may be a pneumatic ram or a hydraulic ram.

When the actuator 316 is in the first operative position, as shown in FIG. 8, the first piston 314 is retracted within first body 302 such that the distal end 318 of the actuator 316 is located at a first distance "x" from the second end portion 308 of the first body 302. Then, when the first piston 314 is in the second operative position, as shown in FIG. 10, the actuator 316 is pushed towards the second end portion 308 of the first body 302, such that the distal end 318 of the actuator 316 is located at a second distance "y" from the second end portion 308. The second distance "y" is greater than the first distance "x".

The ram 300 further comprises a second body 324 having a first end 331 and a second end 333. The second body 324 forms a cartridge that is adapted for being mounted within the first internal cavity 304. As shown in FIGS. 8 to 10, the first end 331 of the second body 324 may be removably mounted to the cap 310 via threads. As such, the second body 302 can be removed from within the first internal cavity 304 by unscrewing the cap 310 and then unscrewing the second body 324 from the cap 310.

The second body 324 comprises a second internal cavity 326 that is defined by an internal wall 328. The second end 333 of the second body 324 defines a passageway 335 that communicates with the exterior of the second internal cavity 326. As shown in FIGS. 8 to 10, the second body 324 is cylindrical in shape. It is to be understood that the second body 324 can be of other shapes and sizes without departing from the spirit of the invention. In addition, the second body 324 can be made from a variety of different materials.

Located within the second internal cavity 326 is a second piston 330 that is attached to a rod. The second piston 330 and the rod 332 are slidably mounted within the second internal cavity 326. As such, the diameter of the rod 332 is slightly smaller than the diameter of the second internal cavity 326. An explosive charge 334 is also located within the second internal cavity 326, such that the portion of the second internal cavity 326 located between the explosive charge 334 and the piston 334 defines a detonation chamber 338.

The explosive charge 334 is adapted for detonating in response to an impulse. As shown in FIGS. 8 to 10, the explosive charge 334 is adapted for detonating in response to an electrical impulse received from wires 336 that extend through the cap 310 of the first end portion 310. It is to be understood that the explosive charge 334 could detonate in response to a chemical impulse or a physical impulse, such as a pressure change, without departing from the spirit of the invention. Different suitable detonators are well known in the art, and no further description is required concerning the various possibilities for triggering the explosive charge 334.

In FIG. 8, the ram 300 is illustrated with the actuator 316 in the first operative position. In this embodiment, the second body 324 extends at least partially within the first piston 314. In an alternative embodiment, the second body does not extend within the first piston 314.

In operation, upon detonation of the explosive charge 334, gas is injected into the detonation chamber 338. The expansion of the gas within the detonation chamber 338 causes the second piston 330 to move the rod 332 from a first position, shown in FIG. 8, to a second position, shown in FIG. 10. As the rod 332 moves from the first position to the second position, it travels in the direction indicated by the arrow 354 shown in FIG. 9. It will be noticed that the detonation chamber 332 expands as the rod 332 moves from the first position to the second position.

As shown in FIG. 9, displacement of the rod 332 from the first position to the second position causes the actuator 316 to move towards the second operative position. More specifically, as the rod 332 moves from the first position towards the second position, it exits the passageway 335 of the second body 324 such that the tip 344 of the rod 332 contacts an abutment surface 340 of the actuator 316. In this manner, the rod 332 pushes against abutment surface 340 thereby causing the actuator 316 to move towards the second operative position.

As shown in FIGS. 8 to 10, the second body 324 comprises passageways 350 for permitting fluid communication between the detonation chamber 338 and the first internal cavity 304. This enables the gas from the detonation chamber 338 to dissipate into a portion of the first internal cavity 304 as the actuator 316 moves towards the second operative position. As such, the portion of the first internal cavity 304 between the first end portion 306 and the first piston 314, defines an expansion chamber 352. The gas that moves from the detonation chamber 338 into the expansion chamber 352 exerts pressure on the first piston 314. As such, the detonation of the explosive charge 334 creates the dual effect of firstly causing the rod 332 to contact the abutment surface 340 of the actuator 316 such that the rod 332 pushes the actuator 316 towards the second operative position, and of secondly causing the gas located in the expansion chamber 352 to exert pressure on the first piston 314, which also causes the actuator 316 to move towards the second operative position. It will be noticed that the expansion chamber 352 expands as the actuator 316 moves towards the second operative position.

The volume of the expansion chamber 352, when the actuator 316 is in the second operative position, is larger than the volume of the detonation chamber 338 such that the heat and pressure from the detonation can dissipate without damaging the components of the ram 300. For instance, the expansion chamber 352 may have a volume that is at least two times greater than the volume of the detonation chamber 338.

As shown in FIGS. 8 to 10, the rod 332 comprises a locking section 346 and the internal wall 328 of the second body 324 includes a locking portion 348. As shown in FIGS. 8 to 10, the locking portion 348 is located within the passageway 335 of the second end 333 of the second body 324.

In operation, when the explosive charge 334 is detonated, and the rod 332 moves from the first position towards the second position as, the locking section 346 of the rod 332 engages with the locking portion 348 of the second body 324. Then once the rod 332 has reached the second position, as shown in FIG. 10, the engagement of the locking portion 348 of the second body 324 and the locking section 346 of the rod 332, prevent the rod 332 from moving back into the second body 324. This in turn prevents the actuator 316 from returning to the first operative position. Therefore, as the gas in the detonation chamber 338 dissipates into the expansion chamber 352, the engagement of the locking portion 348 and the locking section 346 prevents the actuator 316 from being able to move back towards the first operative position.

Figure 14:
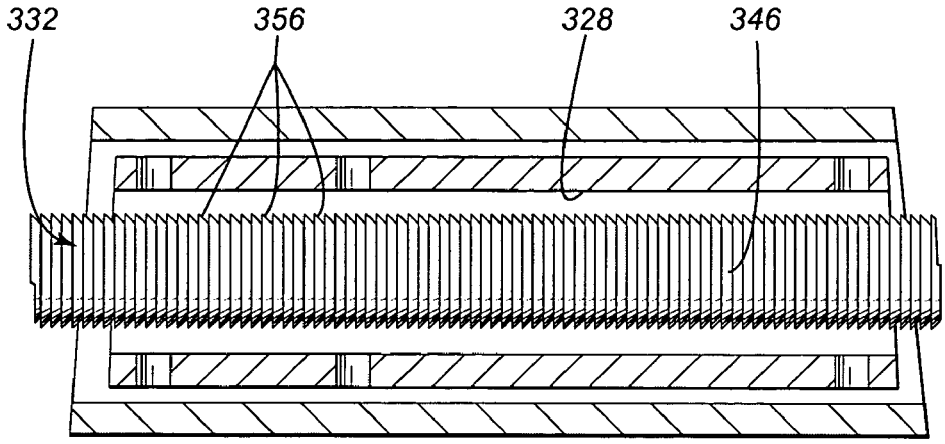
FIG. 14 is a cross sectional view of the locking section of a rod in accordance with an example of implementation of the present invention.
Figure 15:
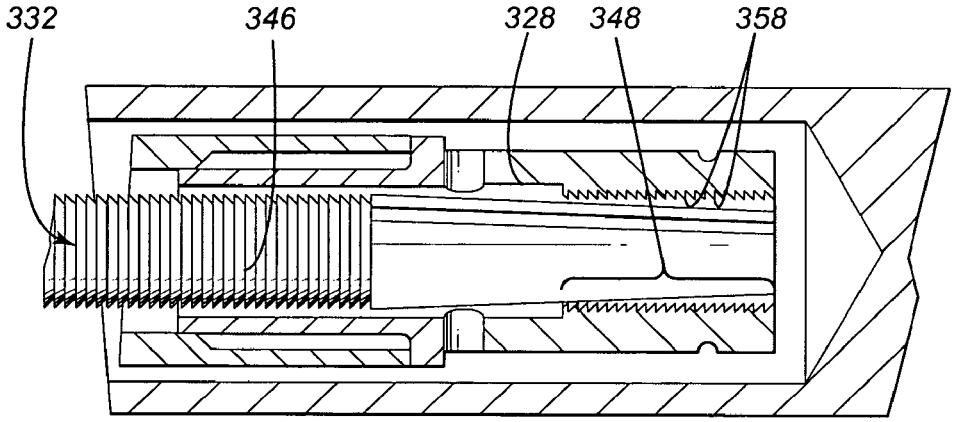
FIG. 15 is a cross sectional view of the locking section of the rod of FIG. 14 prior to engaging with a locking portion of a body.
Figure 16:
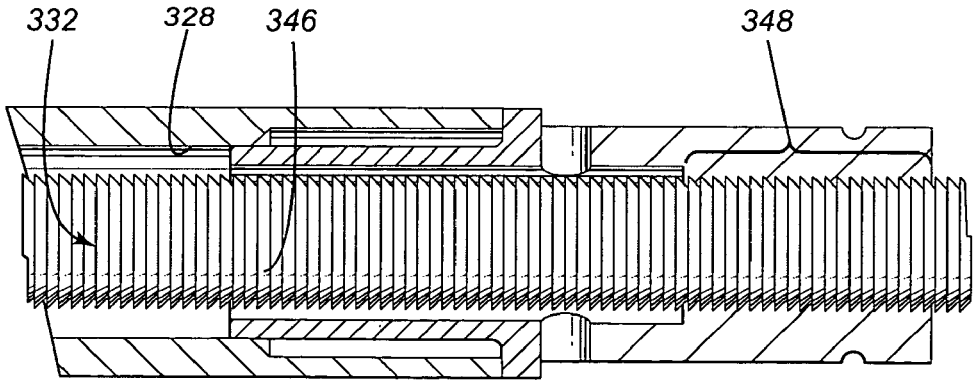
FIG. 16 is a cross sectional view of the locking section of the rod of FIG. 14 engaged with the locking portion of the body.

Shown in FIGS. 14 to 16 is an example of implementation of the locking section 346 of the rod 332 and the locking portion 348 of the second body 324. As shown in FIG. 14, the locking section 346 of the rod 332 comprises a plurality of protrusions 356, each having an angled surface and an abutment surface that is perpendicular to the longitudinal axis of the rod 332. In an embodiment, the angled surfaces may define an angle of about 30–60 degrees with respect to the longitudinal axis of the rod 332. In another embodiment, the angled surfaces may define an angle of 45 degrees with respect to the longitudinal axis of the rod 332.

As shown in FIG. 15, the locking portion 348 of the second body 324 includes a plurality of grooves 358 that each have an abutment surface that is perpendicular to the path of travel of rod 332. As such, as the rod 332 travels from the first position to the second position through the locking portion 348, the angled surfaces of the protrusions 356 are able to slide through locking portion 348. However, when a force is applied to the rod 332 in the opposite direction to that indicated by arrow 354 in FIG. 9, the abutment surfaces of the protrusions 356 abut against the abutment surfaces of the grooves 358, such that the rod 332 is unable to return to the first position.

It should be understood that the locking section 346 can include barbs, fins, or any other type of locking means known in the art, without departing from the spirit of the invention. It should also be understood that the locking section 346 may be provided on all the length of the rod 332 or only on a specific length of the rod 332 (e.g. only from the proximal end of the rod 332 up to its middle).

Moreover, it should be understood that the fluid communication between the detonation chamber 338 and expansion chamber 352 may be realized through other means of communication than passageways 350. For instance, the second piston 330 may allow leakage of gas between its external wall and the internal wall of the second body 324 (e.g. the second piston 330 may comprises grooves or may have a diameter allowing leakage of gas, or the internal wall of the second body 324 may have grooves) and the locking section 346 and the locking portion 348 may also allow leakage of gas such that a portion of the gas from the detonation chamber 338 dissipate into the expansion chamber 352 via a passageway defined between the external wall of the second body 324 and the internal wall of the first piston 314 and the actuator 316.

Figure 11:
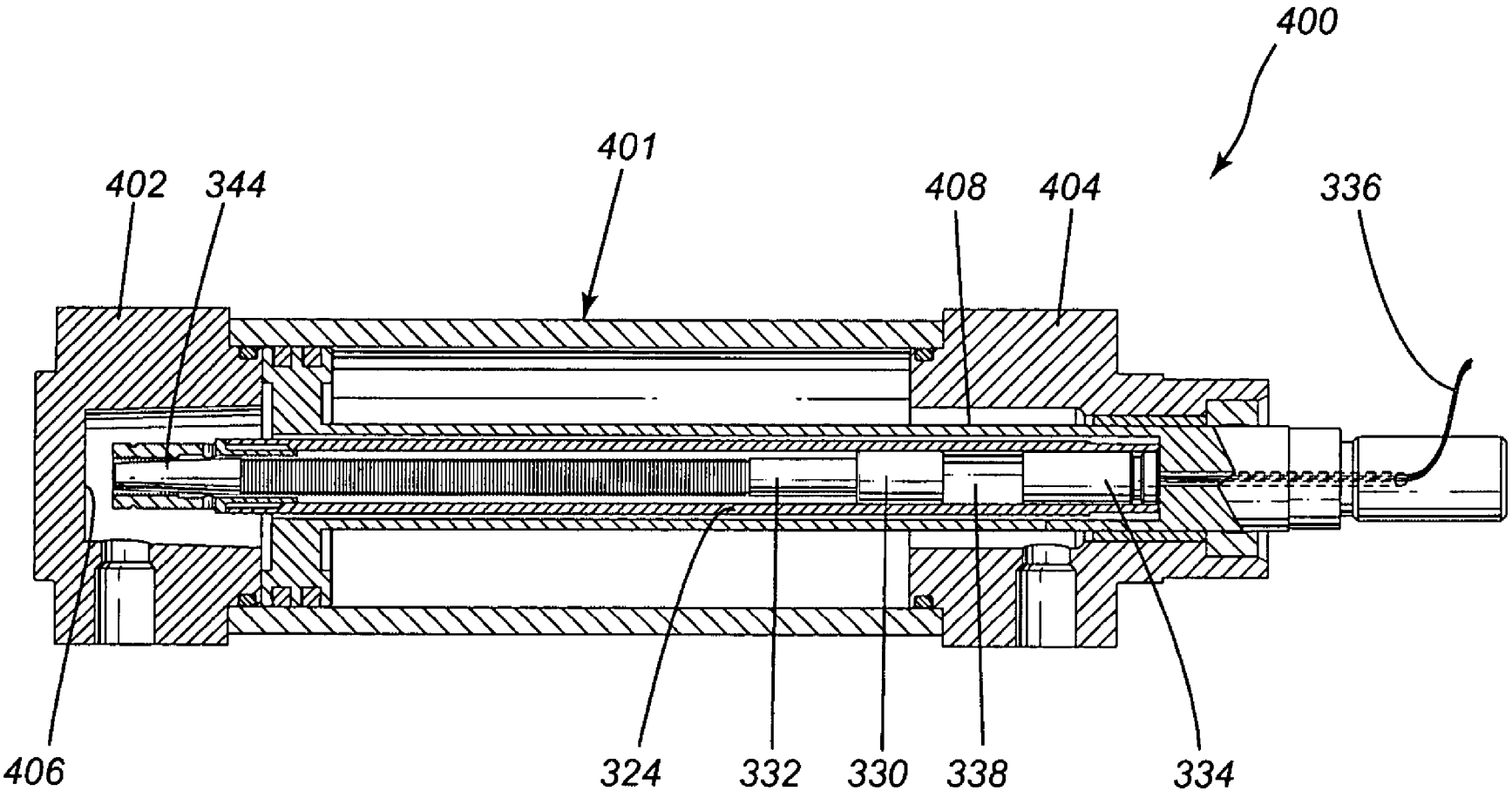
FIG. 11 is a cross sectional view of an autonomous ram constructed in accordance with a fifth embodiment of the invention.
Figure 12:
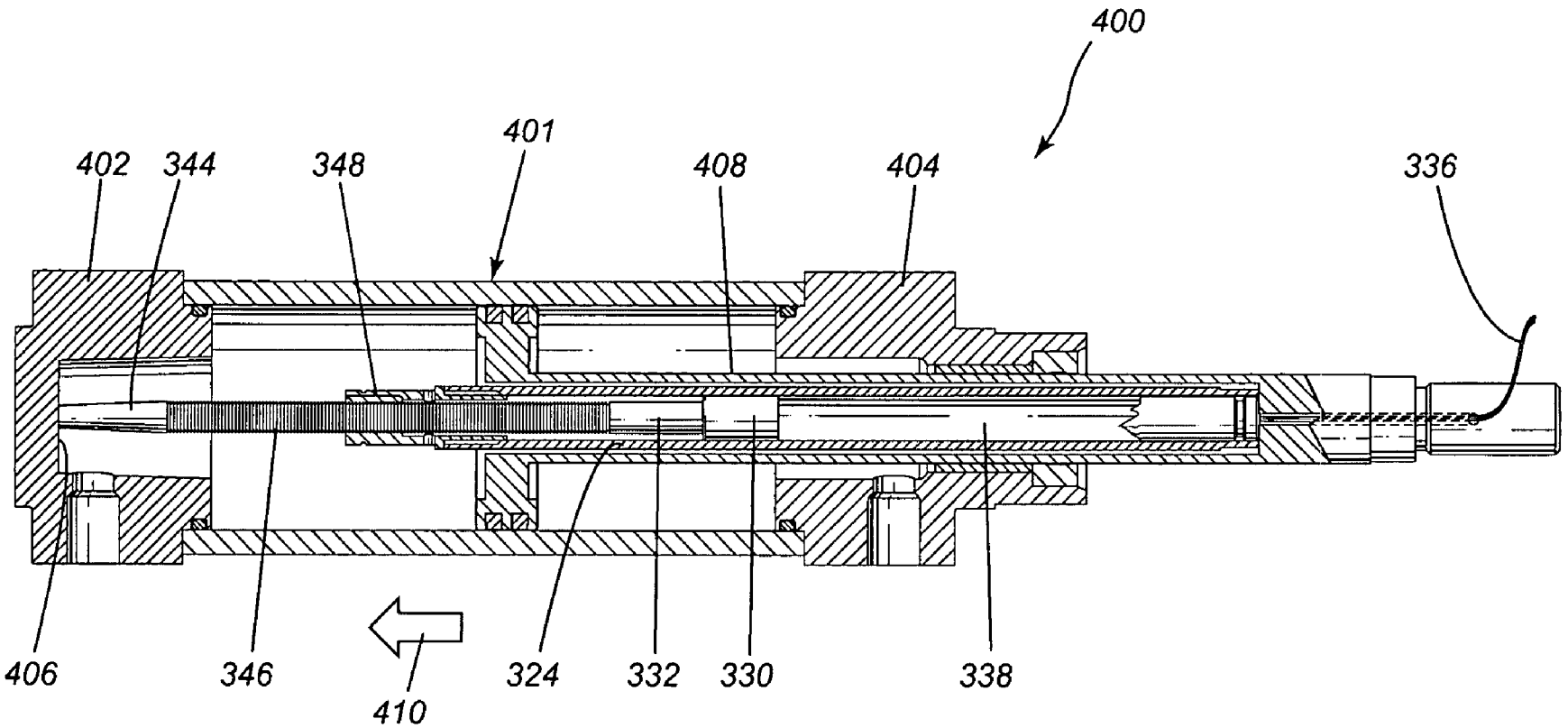
FIG. 12 is a cross sectional view of the autonomous ram of FIG. 11 wherein the actuator is illustrated during its movement towards a second operative position.
Figure 13:
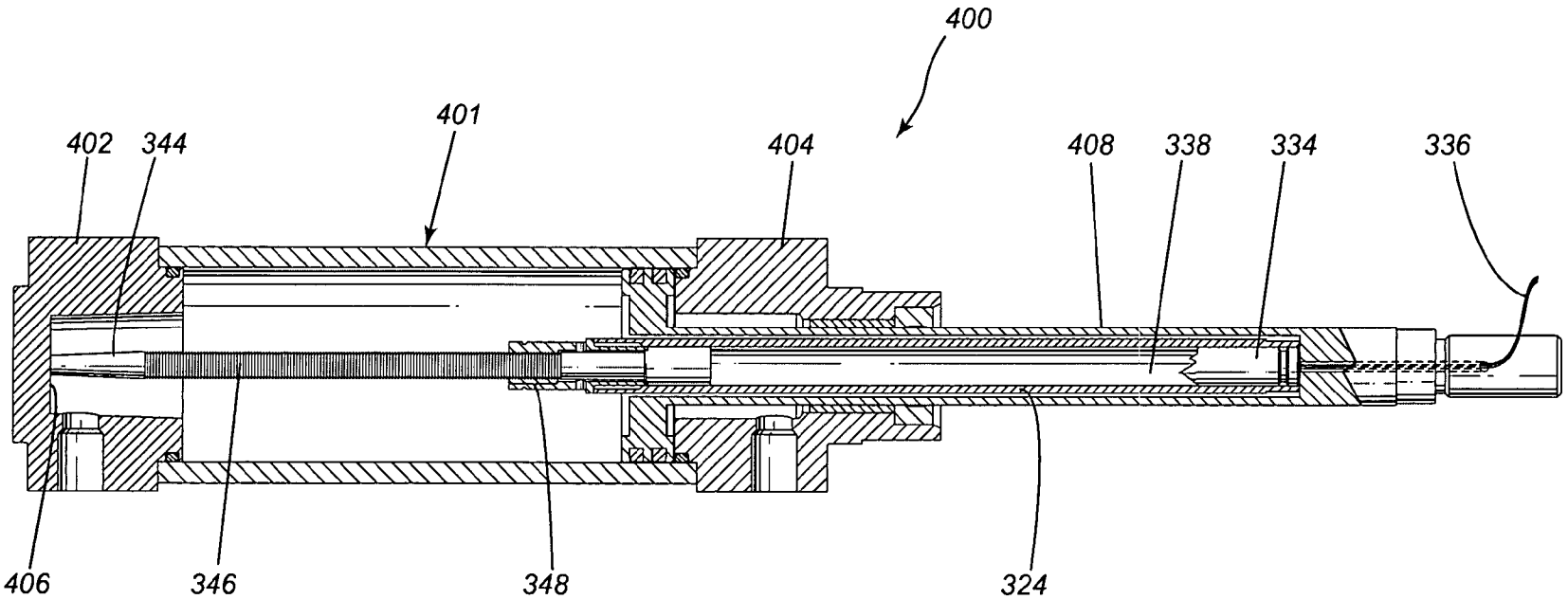
FIG. 13 is a cross sectional view of the autonomous ram of FIG. 11 wherein the actuator is illustrated in the second operative position.

Shown in FIGS. 11 to 13 is an autonomous ram 400 in accordance with a fifth embodiment of the present invention. Since this embodiment is similar to the fourth embodiment, the components used in common are identified by the same reference numerals, and a description of such components will be omitted herein.

In this fifth embodiment, the first body 401 comprises a first end portion 402 that defines an abutment surface 406. The second body 324 is adapted for being mounted to the actuator 408 that is attached to first piston 314. FIG. 11 shows the first piston 314 and actuator 408 in the first operative position.

The explosive charge 334 contained within second body 324 is operative to detonate in response to an impulse, which in the example of implementation shown in FIGS. 11 to 13 is received from the wires 336 that extend through actuator 408. In operation, when the explosive charge 334 detonates, and the second piston 330 is displaced due to the gas pressure created within detonation chamber 338, the rod 332 is operative to move in the direction indicated by arrow 410 shown in FIG. 12. Once the tip 344 of rod 332 abuts against abutment surface 406 of the main body 401, the continuing pressure on second piston 330 causes the second body 324 to start moving in the direction opposite to arrow 410, which thereby causes the actuator 408 to move towards the second operative position, shown in FIG. 13. In the second operative position, the locking section 346 of the rod 332 is engaged with the locking portion 348 of the second body 324, such that the actuator 408 is unable to move back towards the first operative position.

Fluid communication between the detonation chamber 338 and the expansion chamber 352 may be realized in the following manner. The second piston 330 may allow leakage of gas between its external wall and the internal wall of the second body 324 (e.g. the second piston 330 may comprises grooves or may have a diameter allowing leakage of gas, or the internal wall of the second body 324 may have grooves) and the locking section 346 and the locking portion 348 may also allow leakage of gas such that a portion of the gas from the detonation chamber 338 dissipate into the expansion chamber 352.

From the above, it is understood that the autonomous gas powered ram of the invention is actuated by an explosive charge that generates gas and the operation is therefore not dependent upon a source of power such as electrically, hydraulically or pneumatically powered sources. In that sense, even if the source of power is shut down due to a mechanical, electrical or other type of failure, autonomous gas powered ram will nevertheless operate in order to displace the actuator towards the second operative mode.

Similarly, for a ram comprising a fluid-pathway opening for admitting pressurized working fluid, if the source of power which provides pressurized working fluid to the ram is shut down due to a mechanical or electrical failure, or a leakage of the pressurized working fluid, the ram will nevertheless operate in order to displace the actuator towards the second operative mode.

It is understood that in the second operative mode, the actuator may project from the main body of the ram at its utmost distant position relative to the main body or it may retract within the main body at its utmost internal position relative to the main body. It is also understood that the movement imparted to the actuator due to the detonation of the explosive charge can be a movement of rotation, or translation, wherein the actuator is displaced between to different positions relative to the main body of the ram.

Furthermore, in order to stop the movement of components having different weights and speed, it is understood that more than one autonomous gas powered ram can be used and/or autonomous gas powered ram can be sized in function of the weight and maximum speed of a specific component. Hence, autonomous gas powered ram can comprise parts that are designed in order to withstand a maximum specific pressure and temperature. Furthermore, autonomous gas powered ram may be designed in order to comprise an explosive charge that will generate a pressure and move the actuator with a predetermined strength.

The above description of embodiments should not be interpreted in a limiting manner since other variations, modifications and refinements are possible within the spirit and scope of the present invention. The scope of the invention is defined in the appended claims and their equivalents.

What is claimed is:

1. An autonomous gas powered ram, comprising:

(a) a first body defining a first internal cavity;

(b) a first piston mounted within said first internal cavity and being attached to an actuator, said first piston being operative for moving said actuator between a first operative position and a second operative position in relation to said first body, said second operative position being different than said first operative position; and (c) a second body mounted within said first internal cavity, said second body comprising:

i) a second internal cavity defined by an internal wall, said internal wall comprising a locking portion;

ii) an explosive charge located in said second internal cavity, said explosive charge being adapted for detonating in response to an impulse; and iii) a second piston located within said second internal cavity and attached to a rod, said second piston being operative for causing said rod to move from a first position to a second position in response to the detonation of said explosive charge, wherein displacement of said rod from said first position to said second position causes said actuator to move towards said second operative position, and in said second position, said rod is engaged with said locking portion in order to prevent said actuator from returning to said first operative position.

2. An autonomous ram as defined in claim 1, wherein said rod comprises a plurality of protrusions each having an angled surface and an abutment surface.

3. An autonomous ram as defined in claim 2, wherein said rod extends along a longitudinal axis, said angled surfaces defining an angle between 30 and 60 degrees with respect to the longitudinal axis of said rod.

4. An autonomous ram as defined in claim 2, wherein said angled surfaces define an angle of 45 degrees with respect to the longitudinal axis of said rod.

5. An autonomous ram as defined in claim 2, wherein said locking portion of said second body comprises a plurality of grooves having an abutment surface for engaging with the abutment surface of at least one of said plurality of protrusions when said rod is in said second position.

6. An autonomous ram as defined in claim 5, wherein said second body extends at least partially within said first piston.

7. An autonomous ram as defined in claim 6, wherein said impulse is selected from the group consisting of an electrical impulse, a chemical impulse and a pressure change.

8. An autonomous ram as defined in claim 7 wherein said main body comprises a first end portion and a second end portion, said first end portion comprises a cap and said second end portion defines a passageway through which said actuator extends.

9. An autonomous ram as defined in claim 8, wherein said second body is adapted to be connected to said cap.

10. An autonomous ram as defined in claim 9, wherein said cap is removably connected to said first body, and said second body is removably connected to said cap.

11. An autonomous ram as defined in claim 10, wherein said actuator comprises a distal end, said distal end being positioned at a first distance from said second end portion of said main body when said actuator is in said first operative position, and positioned at a second distance from said second end portion of said main body when said actuator is in said second operative position, said second distance being greater than said first distance.

12. An autonomous ram as defined in claim 11, wherein said first body comprises fluid pathways for admitting pressurized working fluid into said first internal cavity for acting on said first piston, thereby enabling said first piston to move said actuator between said first operative position and said second operative position.

13. An autonomous ram as defined in claim 1, wherein said second internal cavity comprises a detonation chamber.

14. An autonomous ram as defined in claim 13, wherein said second body comprises at least one passageway for permitting fluid communication between said detonation chamber and said first internal cavity, such that upon detonation said first internal cavity defines an expansion chamber.

15. An autonomous ram as defined in claim 14, wherein said expansion chamber has a larger volume than said detonation chamber.

16. An autonomous ram as defined in claim 15, wherein gas in said expansion chamber applies pressure on said first piston.

17. A ram, comprising:

(a) a main body comprising an internal cavity;

(b) a first piston slidingly mounted m said internal cavity and capable of movement therein;

(c) a second piston at least partially mounted in said first piston;

(d) an actuator mounted in said main body, said first piston being coupled to said actuator in a driving relationship, whereby movement of said first piston in said internal cavity causes displacement of said actuator with relation to said main body;

(e) a fluid-pathway opening in said internal cavity for admitting pressurized working fluid to act on said first piston to move said first piston and displace said actuator; and (f) an explosive charge located within said ram, said explosive charge being adapted to detonate in response to application of an impulse thereto, a detonation of said explosive charge causing movement of said second piston thereby displacing said actuator relative to said main body, the displacement of said actuator being independent of the pressurized working fluid.

18. An autonomous ram as defined in claim 17, wherein said impulse is selected from the group consisting of an electrical impulse, a chemical impulse and a pressure change.

19. A cartridge suitable for being mounted within the main body of a ram, the main body of the ram having a cavity with a first piston mounted therein for moving an actuator between a first operational position and a second operational position, said cartridge comprising:

(a) an internal cavity defined by an internal wall, said internal wall comprising a locking portion;

(b) an explosive charge located in said internal cavity, said explosive charge being adapted for detonating in response to an impulse; and (c) a second piston located within said internal cavity and attached to a rod, said piston being operative for causing said rod to move from a first position to a second position in response to the detonation of said explosive charge, wherein displacement of said rod from said first position to said second position causes the actuator to move towards the second operative position, and wherein in said second position, said locking portion permanently engages said rod such that the actuator is unable to move back towards the first operative position.

20. A cartridge as defined in claim 19, wherein said rod comprises a plurality of protrusions each having an angled surface and an abutment surface.

21. A cartridge as defined in claim 20, wherein said rod extends along a longitudinal axis, said angled surfaces defining an angle between 30 and 60 degrees with respect to the longitudinal axis of said rod.

22. A cartridge as defined in claim 21, wherein said angled surfaces define an angle of 45 degrees with respect to the longitudinal axis of said rod.

23. A cartridge as defined in claim 22, wherein said locking portion of said cartridge comprises a plurality of grooves having an abutment surface for engaging with the abutment surface of at least one of said plurality of protrusions when said rod is in said second position.

24. A cartridge as defined in claim 23, wherein said cartridge extends at least partially within the piston of the ram.

25. A cartridge as defined in claim 24, wherein said cartridge comprises a detonation chamber.

* * * * *